United States Patent [19]

Breckenfeld et al.

[11] Patent Number: 5,062,403

[45] Date of Patent: Nov. 5, 1991

[54] INTERNAL COMBUSTION ENGINE

[75] Inventors: Paul W. Breckenfeld, Kenosha, Wis.; James A. Nettles, Round Lake, Ill.; Duane E. Rogers, Kenosha, Wis.; George Broughton, Zion, Ill.

[73] Assignee: Outboard Marine Corporation, Waukegan, Ill.

[21] Appl. No.: 525,746

[22] Filed: May 18, 1990

[51] Int. Cl.[5] ..... F02P 5/02

[52] U.S. Cl. ..... 123/413

[58] Field of Search ..... 123/146.5 A, 195 E, 123/195 P, 336, 337, 403, 413

[56] References Cited

U.S. PATENT DOCUMENTS

| | | | |
|---|---|---|---|
| 686,735 | 11/1901 | Jeffrey | 123/406 |
| 1,683,376 | 9/1928 | Williams et al. | 123/146.5 A |
| 1,833,083 | 11/1931 | Lehn | 200/27 A |
| 2,612,883 | 10/1952 | Kiekhaefer | 123/413 X |
| 2,890,689 | 6/1959 | Alexander | 123/413 X |
| 3,105,479 | 10/1963 | Drew | 123/146.5 A |
| 3,203,412 | 8/1965 | Kuritza et al. | 123/617 |
| 3,259,703 | 7/1965 | Vail, Jr. et al. | 200/19 M |
| 3,807,372 | 4/1974 | Garcea | 123/413 |
| 4,602,602 | 7/1986 | Donohue | 123/413 |
| 4,606,314 | 8/1986 | Yamazaki | 123/413 |
| 4,829,961 | 5/1989 | Towner et al. | 123/413 |

*Primary Examiner*—Willis R. Wolfe

*Attorney, Agent, or Firm*—Michael, Best & Friedrich

[57] ABSTRACT

An internal combustion engine comprising an engine block, a spark control member movably mounted on the engine block, means for controlling the spark timing of the engine in response to movement of the spark control member, a first actuating member movably mounted on the engine block, and means for adjustably connecting the first actuating member to the spark control member for common movement therewith.

54 Claims, 6 Drawing Sheets

INTERNAL COMBUSTION ENGINE

BACKGROUND OF THE INVENTION

The invention relates to internal combustion engines, and more particularly to spark timing and throttle control linkages for internal combustion engines.

Attention is directed to the following U.S. Patents:

| | | |
|---|---|---|
| Jeffery | 686,735 | Nov. 19, 1901 |
| Williams, et al. | 1,683,376 | Sept. 4, 1928 |
| Lehn | 1,833,083 | Nov. 24, 1931 |
| Dew | 3,105,479 | Oct. 1, 1963 |
| Kuritza, et al. | 3,203,412 | Aug. 31, 1965 |
| Vail, Jr., et al. | 3,259,703 | July 5, 1966 |

SUMMARY OF THE INVENTION

The invention provides an internal combustion engine comprising an engine block, a spark control member movably mounted on the engine block, means for controlling the spark timing of the engine in response to movement of the spark control member, a first actuating member movably mounted on the engine block, and means for adjustably connecting the first actuating member to the spark control member for common movement therewith.

The invention also provides an internal combustion engine comprising an engine block, a spark control member movably mounted on the engine block, means for controlling the spark timing of the engine in response to movement of the spark control member, an actuating member movably mounted on the engine block, means for adjustably connecting the actuating member to the spark control member for common movement, and means for limiting movement of the actuating member relative to the engine block in the direction retarding the spark timing of the engine.

The invention also provides an internal combustion engine comprising an engine block, an actuating member which is movably mounted on the engine block and which includes a cam surface, a roller arm mounted on the engine block for pivotal movement relative thereto about a roller arm axis, roller means mounted on the roller arm for common movement therewith and for engaging the cam surface, a roller arm actuator having a first end mounted on the engine block for pivotal movement relative thereto and coaxially with the roller arm, means for adjustably connecting the roller arm actuator to the roller arm for common pivotal movement therewith, means for pivoting the roller arm actuator, and means for controlling the spark timing of the engine in response to movement of the actuating member.

The invention also provides an internal combustion engine comprising an engine block, a carburetor which is mounted on the engine block and which includes a throttle valve, a throttle cam mounted on the engine block for pivotal movement relative thereto about a throttle cam axis, means for opening and closing the throttle valve in response to movement of the throttle cam, a roller arm mounted on the engine block for pivotal movement relative thereto about the throttle cam axis, means connecting the throttle cam to the roller arm for common movement therewith, and means for controlling the spark timing of the engine in response to movement of the roller arm.

The invention also provides an internal combustion engine comprising an engine block, a throttle lever mounted on the engine block for movement relative thereto between neutral and open positions, a throttle arm mounted on the engine block for movement relative thereto between a first position, a second position, and a third position beyond the second position, means connecting the throttle arm to the throttle lever for moving the throttle lever from the neutral position to the open position in response to movement of the throttle arm from the first position to the second position, means for substantially preventing movement of the throttle lever beyond the open position, and means for substantially preventing movement of the throttle arm beyond the third position.

The invention also provides an internal combustion engine comprising an engine block including a projection, a throttle lever mounted on the engine block for movement relative thereto between neutral and opened positions, a throttle link mounted on the engine block for movement relative thereto between neutral and open positions, means for moving the throttle link between the neutral and open positions in response to movement of the throttle lever between the neutral and open positions, and means including the projection for substantially preventing movement of the throttle lever beyond the open position and for substantially preventing movement of the throttle link beyond the neutral position.

The invention also provides an internal combustion engine operable in idle and wide-open-throttle conditions and comprising first means for controlling the spark timing of the engine, second means for adjusting the spark timing of the engine when the engine is in the wide-open-throttle condition, and third means operable independently of the second means for adjusting the spark timing of the engine when the engine is in the wide-open-throttle condition.

Other features and advantages of the invention will become apparent to those skilled in the art upon review of the following detailed description, claims and drawings.

Figure 1:
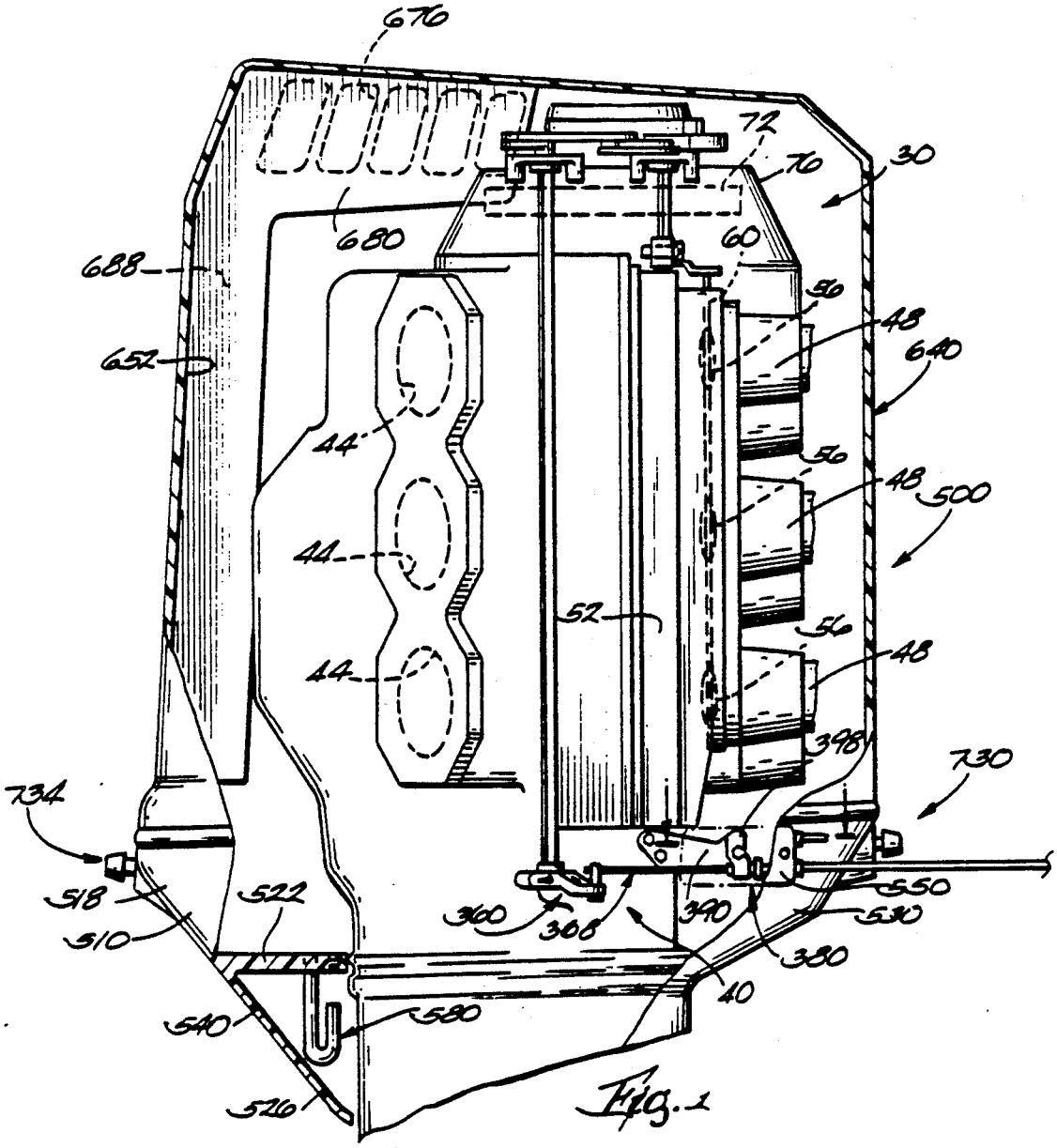
FIG. 1 is a side elevational view of an internal combustion engine embodying the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

An internal combustion engine 30 embodying the invention is illustrated in the drawings. While the engine could be either a two-cycle or a four-cycle engine and could have various applications, the engine 30 is preferably a two-cycle engine used in an outboard motor in the manner described in U.S. Ser. No. 525,862, still pending, which was filed concurrently herewith and which is incorporated herein by reference. Except as described hereinafter, the engine 30 is substantially identical to the engine disclosed in U.S. Ser. No. 316,153, which was filed Feb. 27, 1989, now abandoned, and which is incorporated herein by reference.

The engine 30 is operable between idle and wide-open-throttle conditions and comprises (see FIG. 1) an engine block 40 defining a plurality of cylinders 44. Preferably, the engine block 40 defines two banks of three cylinders each. Only one bank of cylinders is shown FIG. 1. The engine 30 also comprises a plurality of carburetors 48 for supplying combustion air to the cylinders. The carburetors 48 are mounted on the engine block 40 via one or more intake manifolds 52, and each carburetor 48 includes a throttle valve 56 movable between an open position and a closed position. In the preferred embodiment, the engine 30 comprises two intake manifolds 52, and each intake manifold 52 supports a set of three vertically aligned carburetors 48. The throttle valves 56 of each set of carburetors 48 are mounted on a common vertically extending throttle shaft 60. As is known in the art, the throttle valves 56 are biased toward their closed positions.

The engine 30 also comprises (see FIG. 2) a crankshaft 64 supported at least in part by the engine block 40 for rotation relative thereto about a generally vertical crankshaft axis 68. The engine 30 further comprises (see FIG. 1) a flywheel 72 mounted on the crankshaft 64, and a flywheel cover 76 which is mounted on the upper end of the engine block 40 and which covers the flywheel 72. Preferably, the crankshaft 64 extends upwardly through the flywheel 72 and through the flywheel cover 76.

Figure 2:
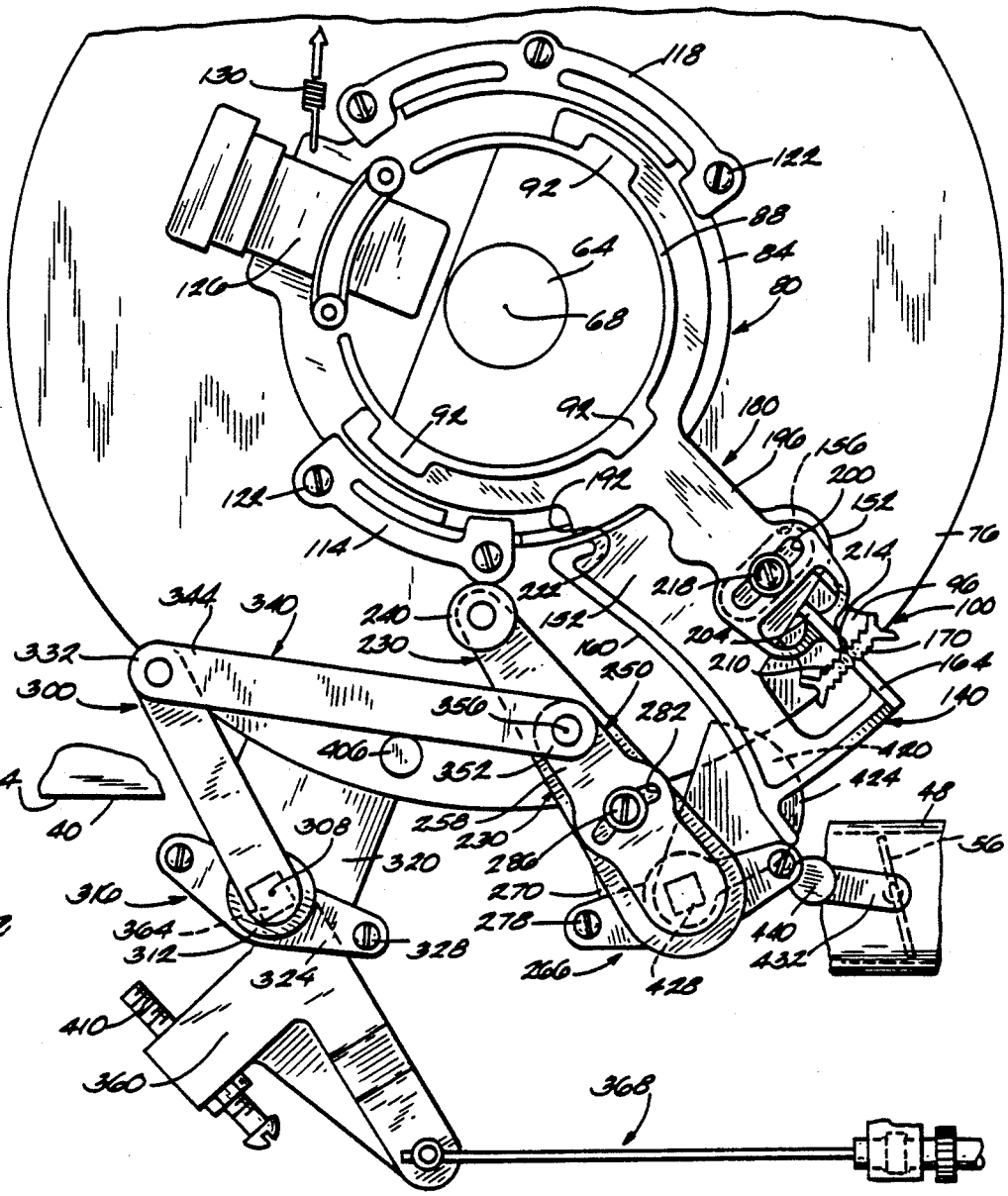
FIG. 2 is a partial top plan view of the engine showing the throttle cam in its neutral position.
Figure 3:
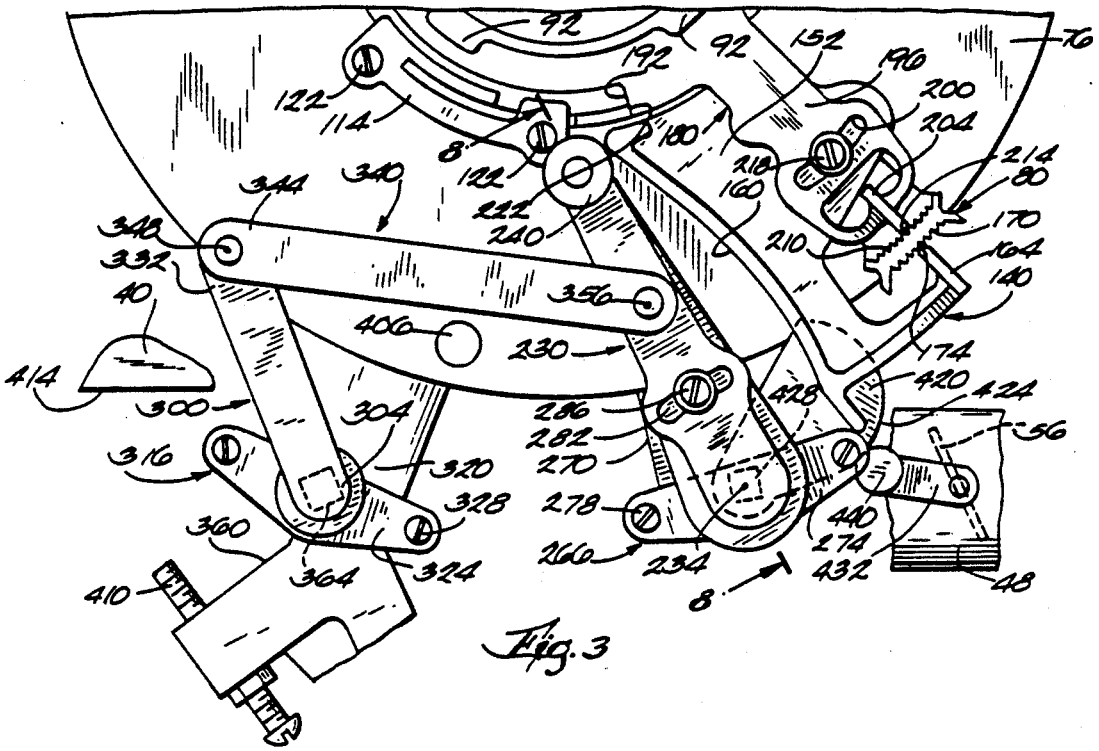
FIG. 3 is view similar to FIG. 2 showing the throttle cam in its closed position.
Figure 9:
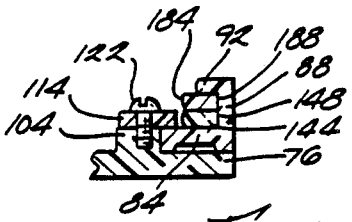
FIG. 9 is a view taken along 9—9 in FIG. 4.
Figure 8:
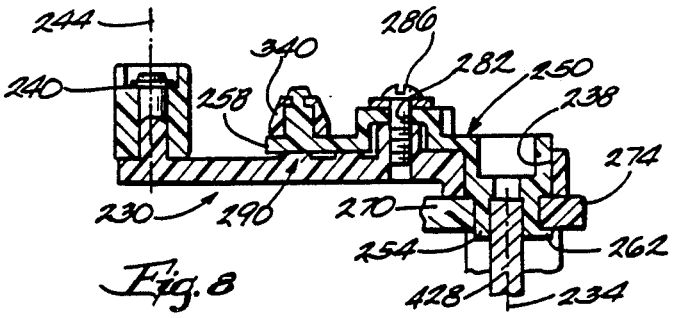
FIG. 8 is view taken along 8—8 in FIG. 3.
Figure 4:
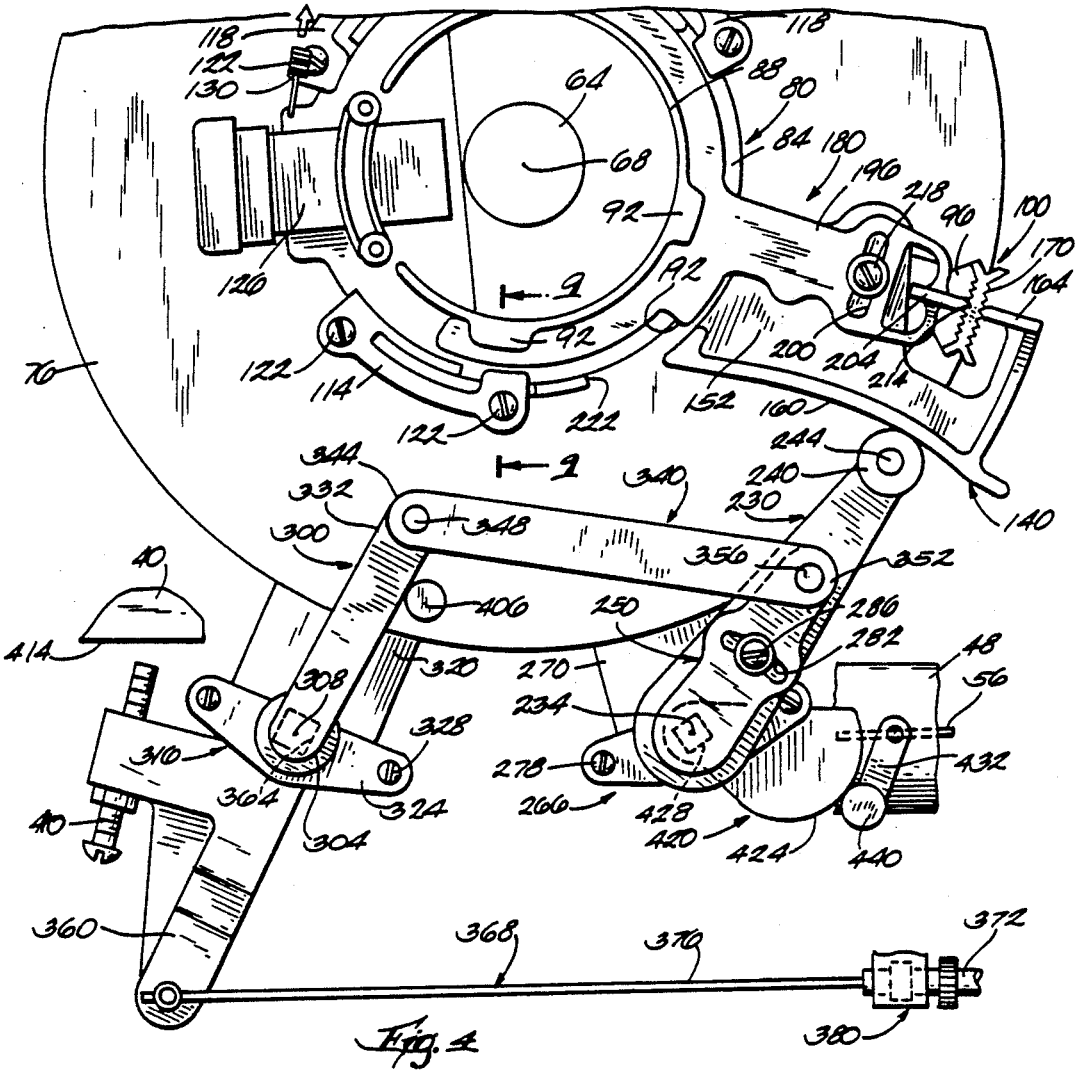
FIG. 4 is a view similar to FIG. 2 showing the throttle cam in its open position.
Figure 5:
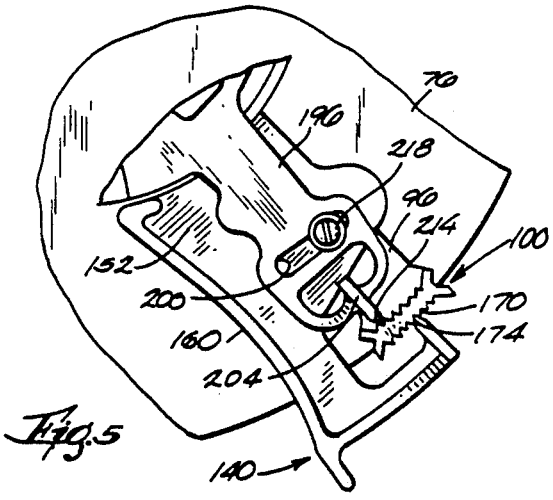
FIG. 5 is partial view similar to FIG. 2 showing adjustment of the second actuating member relative to the spark control member.
Figure 11:
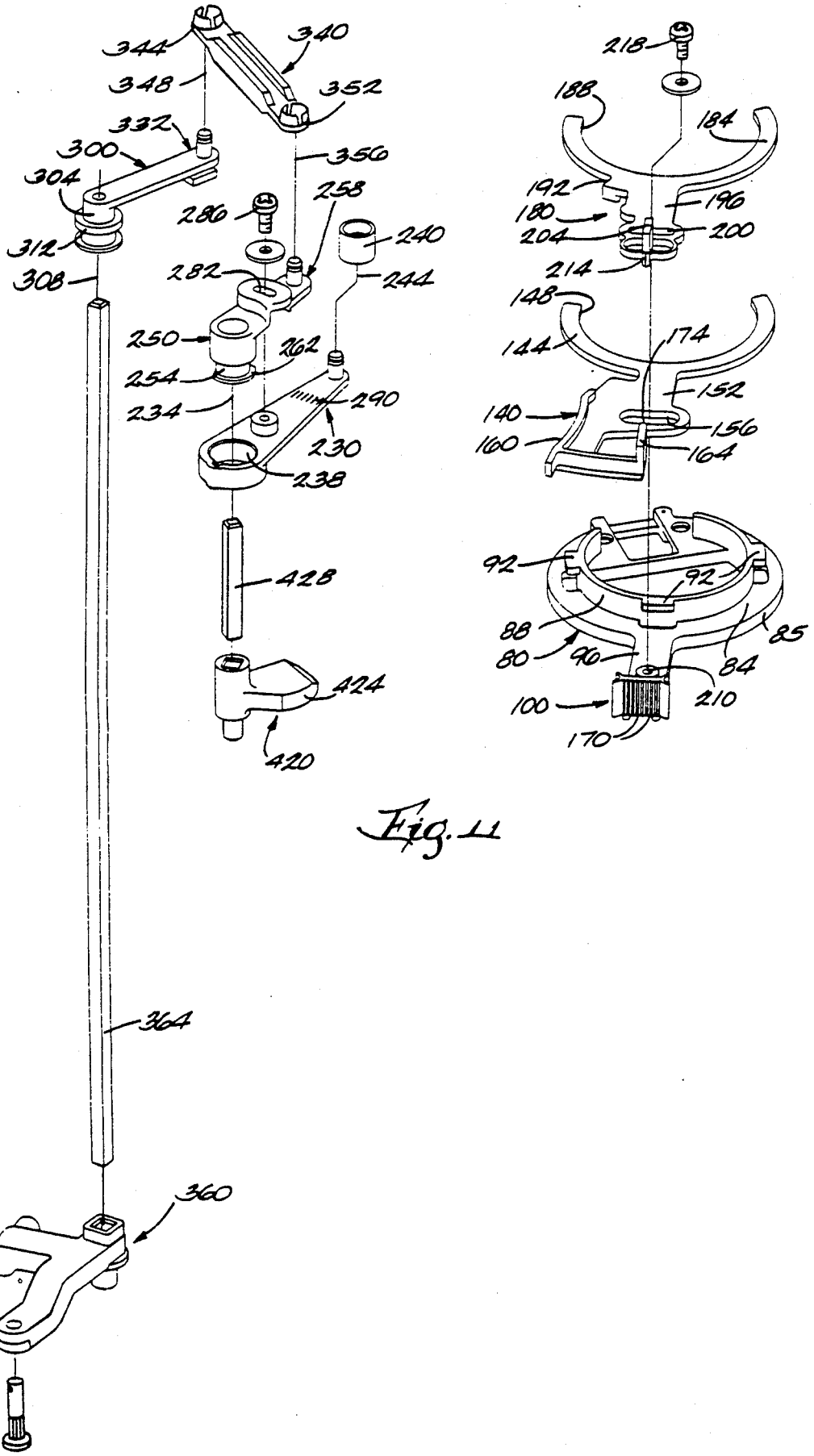
FIG. 11 is an exploded perspective view of the throttle and spark timing linkage of the engine.
Figure 12:
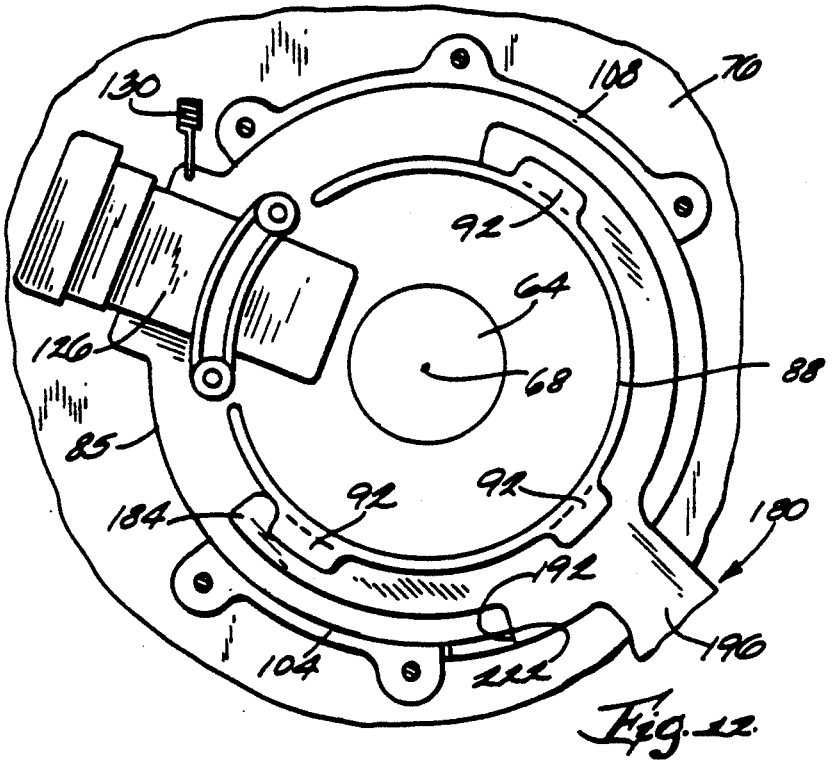
FIG. 12 is a partial plan view similar to FIG. 2 with certain elements removed from the engine.

The engine 30 further comprises (see FIGS. 2–4 and 11) a spark control member 80 mounted on the engine block 40 for movement relative thereto between an idle position (FIGS. 2 and 3) and a wide-open-throttle position (FIG. 4). As shown in FIG. 11, the spark control member 80 includes an annular base portion 84 having a circular periphery 85. The spark control member 80 also includes a cylindrical portion 88 extending upwardly from the base portion 84 and having thereon a plurality of radially outwardly extending projections 92 which, as shown in FIGS. 9 and 11, are spaced from the base portion 84. The spark control member 80 also includes an arm 96 extending radially outwardly from the base portion 84 and having an outer end, and a projection 100 (FIG. 11) extending upwardly from the outer end of the arm 96. In the illustrated construction, the spark control member 80 is mounted on the flywheel cover 76 for pivotal movement relative thereto about the crankshaft axis 68. As shown in FIG. 12, the flywheel cover 76 has thereon a pair of upwardly extending, diametrically opposed, arcuate projections 104 and 108 centered on the crankshaft axis 68. The spark control member 80 is located between the projections 104 and 108 with the periphery 85 of the spark control member 80 in sliding engagement with the projections 104 and 108, and the projections 104 and 108 restrict the spark control member 80 to pivotal movement relative to the flywheel cover 76 about the crankshaft axis 68. As shown in FIGS. 2, 4 and 9, retaining members 114 and 118 respectively mounted on the projections 104 and 108 by suitable means such as screws 122 extend radially inwardly over the spark control member 80 and thereby prevent upward movement of the spark control member 80 relative to the flywheel cover 76.

The engine 30 also comprises means for controlling the spark timing of the engine 30 in response to pivotal movement of the spark control member 80. While various suitable means can be employed, in the preferred embodiment, the controlling means is substantially identical to the means disclosed in U.S. Ser. No. 315,147, which was filed Feb. 24, 1989 and which is incorporated herein by reference. Other suitable controlling means are known in the art. The controlling means includes (see FIG. 2) a control element 126 mounted on the spark control member 80 for common movement therewith. Referring to FIG. 2, counterclockwise movement of the spark control member 80 relative to the engine block 40 advances the spark timing, and clockwise movement of the spark control member 80 relative to the engine block 40 retards the spark timing.

The engine 30 further comprises (see FIG. 2) means for biasing the spark control member 80 in the direction retarding the spark timing of the engine 30, i.e., clockwise in FIG. 2. Such means preferably includes a spring 130 extending between the flywheel cover 76 and the spark control member 80.

The engine 30 also comprises (see FIG. 11) a first or wide-open-throttle actuating member 140 movably mounted on the engine block 40. Preferably, the first actuating member 140 is mounted on the spark control member 80 for pivotal movement relative thereto (and thus relative to the engine block 40) about the crankshaft axis 68. The first actuating member 140 includes an arcuate portion 144 having an inner surface 148 defining an arc centered on the crankshaft axis 68. The arcuate portion 144 partially encircles the cylindrical portion 88 of the spark control member 80 with the inner surface of the arcuate portion 144 in sliding engagement with the outer surface of the cylindrical portion 88, as shown in FIG. 9, so that the arcuate portion 144 is pivotable relative to the spark control member 80 about the crankshaft axis 68. The first actuating member 140 also includes (see FIG. 11) an arm 152 extending radially outwardly from the arcuate portion 144 and having therein an arcuate slot 156, having thereon a cam surface 160, and having thereon a radially inwardly extending projection 164. The reasons for the slot 156, the cam surface 160 and the projection 164 are described below.

The engine 30 further comprises means for adjustably connecting the first actuating member 140 to the spark control member 80 for common movement therewith.

Figure 6:
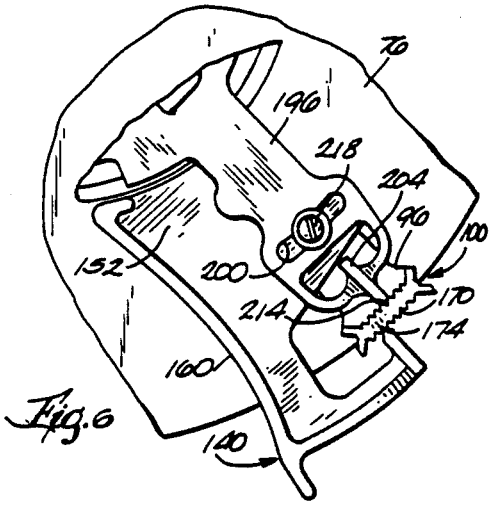
FIG. 6 is a view similar to FIG. 5 showing adjustment of the first actuating member relative to the spark control member.

Preferably, the connecting means permits adjustment of the angular orientation about the crankshaft axis 68 of the first actuating member 140 relative to the spark control member 80 and includes means for locating the first actuating member 140 in a plurality of discrete positions relative to the spark control member 80. In the illustrated construction, the connecting means includes (see FIGS. 2–6) a first plurality of recesses 170 in the spark control member projection 100. The recesses 170 are spaced at 1° intervals along an arc centered on the crankshaft axis 68. As best shown in FIG. 6, the recesses 170 open radially outwardly. The connecting means also includes the projection 164 on the first actuating member 140, which projection 164 includes (see FIG. 3) a pointed end 174 receivable in a selected one of the recesses 170 for locating the first actuating member 140 relative to the spark control member 80. The pointed end 174 of the projection 164 fits relatively snugly into the selected recess 170, and the projection 164 must be deflected in order to be moved to an adjacent recess. Movement of the projection 164 from one recess 170 to an adjacent recess 170 moves the actuating member 1° relative to the spark control member 80.

The engine 30 further comprises (see FIG. 11) a second or upper or idle actuating member 180 movably mounted on the engine block 40. Preferably, the second actuating member 180 is mounted on the spark control member 80 for pivotal movement relative thereto (and thus relative to the engine block 40) about the crankshaft axis 68. The second actuating member 180 includes an arcuate portion 184 which is similar to the arcuate portion 144 of the first actuating member 140 and which has an inner surface 188 defining an arc centered on the crankshaft axis 68. The arcuate portion 184 partially encircles the cylindrical portion 88 of the spark control member 80 with the inner surface of the arcuate portion 184 in sliding engagement with the outer surface of the cylindrical portion 88, as shown in FIG. 9, so that the arcuate portion 184 is pivotable relative to the spark control member 80 about the crankshaft axis 68. The second actuating member 180 also includes (see FIG. 11) a radially extending stop surface 192 and a radial arm 196 having therein a slot 200 and having thereon an upwardly extending projection 204. As shown in FIG. 2, the slot 200 in the second actuating member 180 is radially aligned with the slot 156 in the first actuating member 140. The reasons for the stop surface 192, the slot 200 and the projection 204 are described below.

As best shown in FIG. 9, the spark control member 80 and the actuating members 140 and 180 are mounted on the flywheel cover 76 in stacked but relatively movable relationship, with the first actuating member 140 being sandwiched between the second actuating member 180 and the spark control member 80. The projections 92 on the spark control member 80 extend radially outwardly and over the arcuate portion 184 of the second actuating member 180 so as to prevent upward movement of the second actuating member 180 relative to the spark control member 80 and so as to thereby prevent upward movement of the first actuating member 140 relative to the spark control member 80.

The engine 30 further comprises means for adjustably connecting the second actuating member 180 to the spark control member 80 for common movement therewith. Preferably, the connecting means permits adjustment of the angular orientation about the crankshaft axis 68 of the second actuating member 180 relative to the spark control member 80 and includes means for locating the second actuating member 180 in a plurality of discrete positions relative to the spark control member 80. In the illustrated construction, the connecting means includes (see FIGS. 2–6) a second plurality of recesses 210 in the spark control member projection 100. The recesses 210 are spaced at 1° intervals along an arc centered on the crankshaft axis 68. As shown in FIG. 3, the recesses 210 open radially inwardly. The connecting means also includes the projection 204 on the second actuating member 180, which projection 204 includes a pointed end 214 receivable in a selected one of the recesses 210 for locating the second actuating member 180 relative to the spark control member 80. The pointed end 214 of the projection 204 fits relatively snugly into the selected recess 210, and the projection 204 must be deflected in order to be moved to an adjacent recess 210. Movement of the projection 204 from one recess to an adjacent recess 210 moves the actuating member 1° relative to the spark control member 80.

In the preferred embodiment, the means for adjustably connecting the first and second actuating members 140 and 180 to the spark control member 80 also include the slots 156 and 200 in the first and second actuating members 140 and 180, and a screw 218 (FIGS. 2–4) which extends through the slots and which is threaded into the spark control member 80. Tightening of the screw 218 clamps the actuating members 140 and 180 between the head of the screw 218 and the spark control member 80 and thereby secures the actuating members 140 and 180 relative to the spark control member 80. This arrangement is a redundant safety feature that substantially prevents either of the projections 164 and 204 from slipping out of its selected recess 170 or 210 in the spark control member 80.

The engine 30 further comprises means for limiting movement of the second actuating member 180 relative to the engine block 40 in the direction retarding the spark timing of the engine 30 (clockwise in FIG. 2). While various suitable means can be used, in the preferred embodiment, such means includes (see FIG. 2) a vertically extending end surface 222 on the projection 104 on the flywheel cover 76. As shown in FIG. 2, engagement of the end surface 222 by the stop surface 192 on the second actuating member 180 prevents further clockwise movement of the second actuating member 180 relative to the flywheel cover 76. When the actuating member 180 is secured to the spark control member 80, such engagement also limits movement of the spark control member 80 and thereby determines the spark advance when the engine 30 is at idle.

The engine 30 further comprises means for moving the first actuating member 140 relative to the engine block 40. While various suitable means can be employed, in the illustrated construction, such means includes (see FIGS. 2–4 and 11) a roller arm 230 mounted on the engine block 40 for pivotal movement relative thereto about a generally vertical roller arm axis 234. The roller arm 230 is movable between a neutral position (see FIG. 2) and an open position (FIG. 4). The inner end of the roller arm 230 has therethrough (see FIG. 11) a circular opening 238 centered on the roller arm axis 234. The manner in which the roller arm 230 is mounted on the engine block 40 is described below. The means for moving the actuating member also includes roller means mounted on the roller arm 230 for common movement therewith and for engaging the cam surface 160 on the first actuating member 140. Preferably, the roller means includes (see FIGS. 2–4 and 11) a roller 240 mounted on the outer end of the roller arm 230 for common movement therewith about the roller arm axis 234 and for pivotal movement relative thereto about a generally vertical axis 244. The means for moving the first actuating member 140 also includes means for moving the roller arm 230 relative to the engine block 40. As shown in the drawings, clockwise pivotal movement of the roller arm 230 causes the roller 240 to engage the cam surface 160 and then to move radially outwardly along the cam surface 160 and to thereby move the first actuating member 140 counterclockwise relative to the engine block 40. When the first actuating member 140 is connected to the spark control member 80 for common movement therewith, such movement of the first actuating member 140 advances the spark timing.

While various suitable means can be used for moving the roller arm 230, such means preferably includes (see FIGS. 2–4, 8 and 11) a roller arm actuator 250 having a first or inner end 254 and a second or outer end 258. The inner end of the actuator 250 is mounted on the engine block 40 for pivotal movement relative thereto about the roller arm axis 234. The inner end of the roller arm actuator 250 has thereon a hub 262 which extends through the opening 238 in the roller arm 230 so that the roller arm 230 is pivotable about the hub 262 and thus about the roller arm axis 234. Clip means 266 mounted on the engine block 40 supports the hub 262 for pivotal movement about the roller arm axis 234. The clip means 266 includes a first portion 270 extending from the flywheel cover 76, and a second portion 274 which snaps on to the first portion 270 and which is further secured to the first portion 270 by screws 278. The roller arm actuator hub 262 is captured between the clip portions.

The means for moving the roller arm 230 also includes means for adjustably connecting the roller arm actuator 250 to the roller arm 230 for common pivotal movement therewith. Preferably, such means includes (see FIGS. 8 and 11) a slot 282 in the roller arm actuator 250, which slot extends along an arc centered on the roller arm axis 234, and includes a screw 286 which extends through the slot 282 and which is threaded into the roller arm 230. When the screw 286 is tightened, the roller arm actuator 250 is clamped between the head of the screw 286 and the roller arm 230 and is thereby fixed relative to the roller arm 230. Preferably, the underside of the actuator 250 and the top of the roller arm 230 are serrated at 290 (FIG. 8) in order to resist relative movement of the actuator 250 and the roller arm 230.

The means for moving the roller arm 230 also includes means for pivoting the roller arm actuator 250 about the roller arm axis 234. The roller arm actuator 250 is pivotable between a neutral position corresponding to the neutral position of the roller arm 230 and an open position corresponding to the open position of the roller arm 230. While various suitable pivoting means can be employed, in the preferred embodiment, such means includes (see FIGS. 2–4 and 11) a throttle lever 300 having a first or inner end 304 mounted on the engine block 40 for pivotal movement relative thereto about a generally vertical throttle lever axis 308. More particularly, the inner end of the throttle lever 300 has thereon a hub 312 centered on the throttle lever axis 308, and the engine 30 comprises clip means 316 which is mounted on the engine block 40 and which supports the throttle lever hub 312 for pivotal movement relative to the engine block 40. The clip means includes a first portion 320 extending from the flywheel cover 76, and a second portion 324 which snaps on to the first portion 320 and which is further secured to the first portion 320 by screws 328. The throttle lever hub 312 is captured between the clip portions. The throttle lever 300 also has a second or outer end 332, and the means for pivoting the roller arm actuator 250 also includes a throttle link 340 having a first end 344 connected to the outer end of the throttle lever 300 for pivotal movement relative thereto about a generally vertical axis 348, and a second end 352 connected to the second or outer end of the roller arm actuator 250 for pivotal movement relative thereto about a generally vertical axis 356. Referring to FIG. 4, clockwise pivotal movement of the throttle lever 300 acts through the throttle link 340 to cause clockwise pivotal movement of the roller arm actuator 250.

Figure 10:
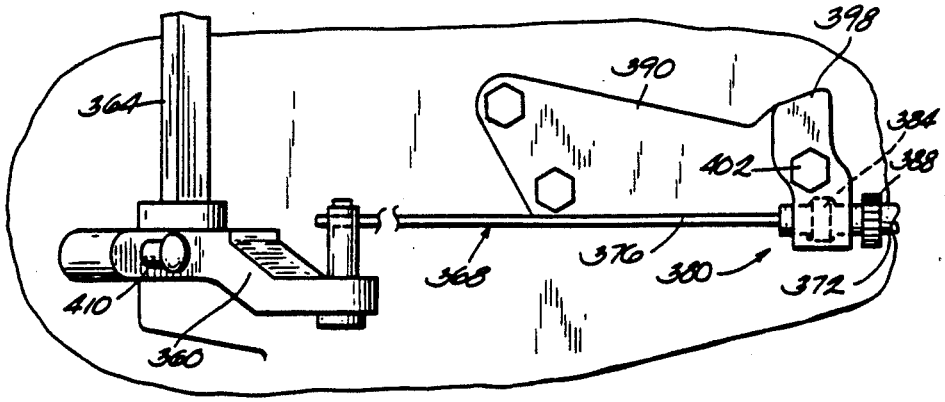
FIG. 10 is an enlarged, partial side elevational view of the engine.

The means for pivoting the roller arm actuator 250 also includes means for pivoting the throttle lever 300. Preferably, this means includes (see FIGS. 2–4 and 11) a throttle arm 360 mounted on the engine block 40 for pivotal movement relative thereto about the throttle lever axis 308, a shaft 364 extending along the throttle lever axis 308 and connecting the throttle arm 360 to the throttle lever 300, and means for pivoting the throttle arm 360. While various suitable means can be employed for pivoting the throttle arm 360, in the preferred embodiment, such means includes (see FIG. 10) a conventional push-pull cable 368 having one end operably connected to the throttle arm 360. The cable 368 preferably includes an externally threaded outer sheath 372, and an inner core 376 slideably housed within the outer sheath. The core 376 is connected to the throttle arm 360 for pivoting the throttle arm 360 in response to movement of the core 376 relative to the sheath 372. The cable 368 also includes a trunnion 380 threaded onto the outer sheath 372 such that rotation of the trunnion 380 relative to the sheath 372 causes axial movement of the trunnion 380 relative to the sheath 372. The trunnion 380 includes an enlarged portion 384 and also includes a knurled knob portion 388 dimensioned and shaped to be easily grasped and rotated by an operator's fingers. In the illustrated construction, the engine 30 also includes a cable support arm 390 mounted on the engine block 40, a trunnion block (not shown) fixed to the cable support arm, and a trunnion block cover 398 removably secured to the trunnion block so as to capture the enlarged portion 384 of the trunnion 380 between the trunnion block cover 398 and the trunnion block. The trunnion block cover 398 is preferably removably secured to the trunnion block by a screw 402. Engagement of the trunnion 380 by the trunnion block and trunnion block cover 398 prevents axial movement of the trunnion 380 relative to the trunnion block while permitting rotation of the trunnion 380 relative to the trunnion block. Rotation of the trunnion 380 relative to the trunnion block and relative to the cable sheath 372 causes axial movement of the sheath 372 relative to the trunnion block and thus relative to the engine block 40. Accordingly, the position of the cable sheath 372 relative to the engine block 40 is adjusted by rotating the trunnion 380.

The opposite end of the cable 368 is operably connected to a remote control device (not shown). The remote control device is preferably a single lever control and includes a control lever movable between forward, neutral and reverse positions. The remote control device moves the cable core 376 relative to the cable sheath 372 so as to move the throttle arm 360 from its closed position to its open position in response to movement of the control lever to either forward or reverse. Other types of remote control devices (e.g., not single lever controls) can be employed.

The throttle arm 360 is movable relative to the engine block 40 between a first or neutral or idle position (FIG. 2), a second or open or wide-open-throttle position (FIG. 4), and a third or beyond-open position (FIG. 7) beyond the second position. When the throttle arm 360 is in its neutral position (see FIG. 4), the throttle lever 300 is in a neutral position and the throttle link 340 is in a neutral position. When the throttle arm 360 is in its open position, the throttle lever 300 is in an open position and the throttle link 340 is in an open position. Thus, the throttle lever 300 moves from its neutral position to its open position in response to movement of the throttle arm 360 from its first or neutral position to its second or intermediate position, and the throttle link 340 moves between its neutral and open positions in response to movement of the throttle lever 300 between its neutral and open positions.

The engine 30 further comprises means for limiting movement of the throttle lever 300 in the direction advancing the spark timing of the engine 30, i.e., clockwise in FIG. 2. Preferably, such means includes means for substantially preventing movement of the throttle lever 300 beyond its open position. While various suitable means can be employed, in the preferred embodiment, such means includes (see FIG. 4) an upwardly extending projection or pin 406 on the flywheel cover 76. As shown in FIG. 4, the throttle lever 300 engages the projection 406 when the throttle lever 300 is in its open position.

The engine 30 further comprises means for limiting movement of the throttle link 340 in the direction retarding the spark timing of the engine 30. Preferably, such means substantially prevents movement of the throttle link 340 beyond its neutral position. While various suitable means can be employed, in the preferred embodiment, such means includes the projection 406. As shown in FIG. 2, the throttle link 340 engages the projection 406 when the throttle link 340 is in its neutral position.

Thus, the projection 406 serves both to substantially prevent movement of the throttle lever 300 beyond its open position and to substantially prevent movement of the throttle link 340 beyond its neutral position.

Figure 7:
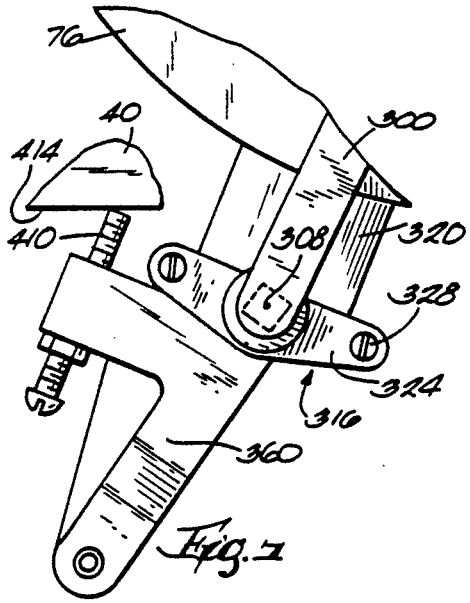
FIG. 7 is a partial view similar to FIG. 2 showing the throttle arm in its beyond-open position.

The engine 30 further comprises means for limiting movement of the throttle arm 360 in the direction advancing the spark timing of the engine 30. Preferably, such means substantially prevents movement of the throttle arm 360 beyond its beyond-open position. Preferably, as shown in FIG. 7, the throttle arm 360 has threadedly mounted thereon a screw 410, and the engine block 40 includes a limit surface 414 which is engaged by the screw 410 when the throttle arm 360 is in its beyond-open position. Engagement of the limit surface 414 by the screw 410 limits over-travel of the throttle arm 360 (i.e., movement of the throttle arm 360 beyond its open position) in the event the operator forces the throttle arm 360 in the direction from its neutral position to its open position after the throttle lever 300 has engaged the projection 406. While the projection 406 prevents further movement of the throttle lever 300, it may be possible for the operator to continue to move the throttle arm 360 by twisting the shaft 364. Engagement of the limit surface 414 by the screw 410 thus limits twisting of the shaft 364.

The engine 30 further comprises (see FIGS. 2–4 and 11) a throttle cam 420 mounted on the engine block 40 for pivotal movement relative thereto about the roller arm axis 234. In illustrated construction, the throttle cam 420 is pivotally mounted on the upper end of one of the intake manifolds 52. The throttle cam 420 has thereon a cam surface 424, the reason for which is explained below. The engine 30 further comprises means for connecting the throttle cam 420 to the roller arm actuator 250 for common movement therewith. While various suitable connecting means can be employed, in the preferred embodiment, such means includes a shaft 428 extending along the roller arm axis 234 and connecting the throttle cam 420 to the roller arm actuator 250. The throttle cam 420 is in a neutral position when the throttle lever 300 is in its neutral position, is in a closed position when the throttle cam 420 initially engages the below-described throttle roller 440, and is in an open position when the throttle lever 300 is in its open position.

The engine 30 further comprises means for opening and closing the throttle valves 56 in response to movement of the throttle cam 420, i.e., for moving the throttle valves 56 from their closed positions to their open positions in response to movement of the throttle cam 420 from its closed position to its open position. Preferably, the means for opening and closing the throttle valves 56 includes (see FIGS. 1–4) a rocker arm 432 fixed to the upper end of one of the throttle shafts 60, and a throttle roller 440 which engages the cam surface 424 and which is pivotally mounted on the rocker arm 432. The rocker arm 432 is operably connected to the other throttle shaft 60 by a suitable linkage (not shown). Counterclockwise movement of the rocker arm 432 opens the throttle valves 56, and clockwise movement of the rocker arm 432 closes the throttle valves 56. The roller 440 is located in a closed position when the throttle valves 56 are closed and in an open position when the throttle valves 56 are open. The roller 440 is biased to its closed position and thereby toward the cam surface 424 because the throttle valves 56 are biased to their closed positions. Such arrangements for opening and closing throttle valves are known in the art.

Preferably, as shown in FIG. 2, the roller 240 is slightly spaced from the cam surface 160 and the throttle cam 420 is slightly spaced from the roller 440 when the throttle arm 360 is in its neutral or idle position. This allows the control cable 368 to stretch somewhat without affecting the spark timing or throttle opening when the engine 30 is in neutral. (Stretching of the control cable would move the roller 240 closer to the cam surface 160 and move the throttle cam 420 closer to the roller 440 when the engine 30 is in neutral). Because the roller 240 is spaced from the cam surface 160 and the throttle cam 420 is spaced from the roller 440 when the engine 30 is idling, there is some initial lost motion of the control cable before commencement of spark advance and throttle opening.

The throttle and spark timing linkage is adjusted as follows. First, the throttle arm 360 is placed in its neutral position (see FIG. 2) by placing the throttle link 340 against the projection 406. Then the control cable 368 is adjusted by putting the remote control device in neutral and rotating the cable trunnion 380 so that the cable core 376 is under slight tension. This removes any slop from the cable.

Next, the relative positions of the spark control member 80 and the first actuating member 140 are adjusted in order to set the spark timing at wide-open throttle. This is done by moving the roller arm 230 to its open position (see FIG. 4), so that the first actuating member 140 is in the position it will be in when the throttle arm 360 is in its open position. Then the position of the spark control member 80 relative to the first actuating member 140 is adjusted (see FIG. 6) t provide the desired spark advance at wide-open throttle.

Next, the relative positions of the spark control member 80 and the second actuating member 180 are adjusted to provide the desired spark advance or engine 30 speed at idle This is done by moving the roller arm 230 to its neutral position (FIG. 2), where it will be when the engine 30 is idling, and by placing the second actuating member 180 against the end surface 222 (where the member 180 will be when the engine 30 is idling). Then the position of the spark control member 80 relative to the second actuating member 180 is adjusted (see FIG. 5) to provide the desired spark advance or engine 30 speed at idle.

The engine 30 thus comprises means for adjusting the spark timing at wide-open-throttle, and means operable independently of the means for adjusting the spark timing at wide-open-throttle for adjusting the spark timing at idle. It should be noted that the previous two steps, i.e., adjusting the position of the first actuating member 140 relative to the spark control member 80 and adjusting the position of the second actuating member 180 relative to the spark control member 80, can be performed in either order.

Finally, the throttle cam 420 is synchronized with the roller arm 230. More particularly, the roller arm 230 is moved clockwise from its neutral position to the position in which the roller 240 initially contacts the cam surface 160 on the first actuating member 140 (see FIG. 3), and then the position of the roller arm actuator 250 relative to the roller arm 230 is adjusted so that the throttle cam 420 is in its closed position, i.e., the position in which the throttle cam 420 initially contacts the throttle roller 440. As a result, during movement of the throttle arm 360 from its neutral position toward its open position, the roller 240 contacts the cam surface 160 at the same time as the throttle cam 420 contacts the roller 440.

The throttle and spark timing linkage operates as follows. When the engine 30 is idling and the remote control is in neutral, the throttle arm 360, the throttle lever 300, the throttle link 340, the roller arm actuator 250, the roller arm 230 and the throttle cam 420 are in their neutral positions (see FIG. 2), the throttle valves 56 are closed, and the spark control member 80 is in its idle position. The roller 240 is slightly spaced from the cam surface 160, and the throttle cam 420 is slightly spaced from the throttle roller 440. Movement of the throttle arm 360 toward its open position causes movement of the throttle lever 300, the throttle link 340, the roller arm actuator 250, the roller arm 230 and the throttle cam 420 toward their open positions. When the throttle cam 420 reaches its closed position (see FIG. 3), the throttle cam 420 engages the throttle roller 440 and the roller 240 engages the cam surface 160. Thereafter, movement of the roller arm actuator 250 toward its open position acts through the roller arm 230, the roller 240 and the first actuating member 140 to move the spark control member 80 toward its wide-open-throttle position (see FIG. 4), and acts through the shaft 428, the throttle cam 420, the throttle roller 440 and the rocker arm 432 to move the throttle valves 56 toward their open positions. When the roller arm actuator 250 is in its open position (see FIG. 4), the spark control member 80 is in its wide-open-throttle position, and the throttle valves 56 are in their open positions. Further movement of the throttle arm 360 toward its beyond-open position (see FIG. 7) will not move the throttle lever 300 due to engagement of the throttle lever 300 by the pin 406. Movement of the throttle arm 360 beyond its beyond-open position is substantially prevented by engagement of the screw 410 by the limit surface 414.

Various features of the invention are set forth in the following claims.

We claim:

1. An internal combustion engine comprising an engine block, a spark control member movably mounted on said engine block, means for controlling the spark timing of said engine in response to movement of said spark control member, a first actuating member movably mounted on said engine block, and means for adjustably connecting said first actuating member to said spark control member for effecting common movement of said first actuating member and said spark control member in response to operating movement of said first actuating member and for permitting adjustment of said spark control member relative to said actuating member independently of operating movement of said first actuating member.

2. An engine as set forth in claim 1 and further comprising a crankshaft supported by said engine block for rotation relative thereto about a crankshaft axis, wherein said spark control member is mounted on said engine block for pivotal movement about said crankshaft axis, and wherein said first actuating member is mounted on said engine block for pivotal movement about said crankshaft axis.

3. An engine as set forth in claim 2 wherein said means for adjustably connecting said first actuating member to said spark control member permits adjustment of the angular orientation about said crankshaft axis of said first actuating member relative to said spark control member.

4. An engine as set forth in claim 3 wherein said connecting means includes a plurality of recesses in said spark control member and a projection which is located on said first actuating member and which is receivable in a selected one of said recesses for locating said first actuating member relative to said spark control member.

5. An engine as set forth in claim 4 wherein said recesses are spaced generally along an arc centered on said crankshaft axis, and wherein said projection extends radially of said crankshaft axis.

6. An engine as set forth in claim 5 and further comprising a second actuating member mounted on said engine block for pivotal movement relative thereto about said crankshaft axis, and means for connecting said second actuating member to said spark control member for common movement therewith and for permitting adjustment of the angular orientation about said crankshaft axis of said second actuating member relative to said spark control member.

7. An engine as set forth in claim 6 wherein said means connecting said second actuating member to said spark control member includes a plurality of recesses in said spark control member and a projection which is located on said second actuating member and which is receivable in a selected one of said recesses for locating said second actuating member relative to said spark control member.

8. An engine as set forth in claim 7 wherein said recesses are spaced generally along an arc centered on said crankshaft axis, and wherein said projection extends radially of said crankshaft axis.

9. An engine as set forth in claim 1 wherein said controlling means is mounted on said spark control member.

10. An engine as set forth in claim 1 wherein said means for adjustably connecting said first actuating member to said spark control member includes means for locating said first actuating member in a plurality of discrete positions relative to said spark control member.

11. An engine as set forth in claim 10 wherein said locating means includes a plurality of recesses in one of said first actuating member and said spark control member and a projection which is located on the other of said first actuating member and said spark control member and which is receivable in a selected one of said recesses for locating said first actuating member relative to said spark control member.

12. An engine as set forth in claim 1 wherein said means for adjustably connecting said first actuating member to said spark control member includes a slot in one of said first actuating member and said spark control member and a screw which extends through said slot and which is threaded into the other of said first actuating member and said spark control member.

13. An engine as set forth in claim 1 and further comprising a second actuating member movably mounted on said engine block, and means for adjustably connecting said second actuating member to said spark control member for common movement therewith.

14. An engine as set forth in claim 13 and further comprising a crankshaft supported by said engine block for rotation relative thereto about a crankshaft axis, wherein said spark control member is mounted on said engine block for pivotal movement about said crankshaft axis, and wherein said second actuating member is mounted on said engine block for pivotal movement about said crankshaft axis.

15. An engine as set forth in claim 13 wherein said means for adjustably connecting said second actuating member to said spark control member includes means for locating said second actuating member in a plurality of discrete positions relative to said spark control member.

16. An engine as set forth in claim 15 wherein said locating means includes a plurality of recesses in one of said second actuating member and said spark control member and a projection which is located on the other of said second actuating member and said spark control member and which is receivable in a selected one of said recesses for locating said second actuating member relative to said spark control member.

17. An engine as set forth in claim 13 and further comprising means for biasing said spark control member in the direction retarding the spark timing of said engine, and means for limiting movement of said second actuating member relative to said engine block in the direction retarding the spark timing of said engine.

18. An engine as set forth in claim 1 and further comprising means for moving said first actuating member relative to said engine block.

19. An engine as set forth in claim 18 wherein said first actuating member includes a cam surface, and wherein said moving means includes a roller arm mounted on said engine block for pivotal movement relative thereto about a roller arm axis, means for moving said roller arm relative to said engine block, and roller means mounted on said roller arm for common movement therewith and for engaging said cam surface.

20. An engine as set forth in claim 19 and further comprising a crankshaft supported by said engine block for rotation relative thereto about a crankshaft axis, wherein said spark control member and said first actuating member are mounted on said engine block for pivotal movement about said crankshaft axis, and wherein said roller arm is mounted on said engine block for pivotal movement about an axis extending generally parallel to said crankshaft axis.

21. An engine as set forth in claim 19 wherein said means for moving said roller arm includes a roller arm actuator having a first end mounted on said engine block for pivotal movement relative thereto and about said roller arm axis, means for adjustably connecting said roller arm actuator to said roller arm for common pivotal movement therewith, and means for pivoting said roller arm actuator.

22. An engine as set forth in claim 21 wherein said means for adjustably connecting said roller arm actuator to said roller arm includes a slot in one of said actuator and said roller arm, and a screw which extends through said slot and which is threaded into the other of said actuator and said roller arm.

23. An engine as set forth in claim 21 wherein said pivoting means includes a throttle lever having a first end mounted on said engine block for pivotal movement relative thereto about a throttle lever axis extending generally parallel to said roller arm axis, and said throttle lever having a second end, a throttle link having a first end connected to said second end of said throttle lever for pivotal movement relative thereto about an axis extending generally parallel to said roller arm axis, and having a second end connected to said actuator for pivotal movement relative thereto about an axis extending generally parallel to said roller arm axis, and means for pivoting said throttle lever.

24. An engine as set forth in claim 23 wherein said means for pivoting said throttle lever includes a throttle arm mounted on said engine block for pivotal movement relative thereto about said throttle lever axis, a shaft extending along said throttle lever axis and connecting said throttle arm to said throttle lever, and means for pivoting said throttle arm.

25. An engine as set forth in claim 24 wherein said means for pivoting said throttle arm includes a push-pull cable.

26. An engine as set forth in claim 24 and further comprising means for limiting movement of said throttle arm in the direction advancing the spark timing of said engine.

27. An engine as set forth in claim 26 wherein said engine block includes a limit surface, and wherein said means for limiting movement of said throttle arm includes said limit surface.

28. An engine as set forth in claim 23 and further comprising means for limiting movement of said throttle lever in the direction advancing the spark timing of said engine.

29. An engine as set forth in claim 28 wherein said engine block includes a projection, and wherein said means for limiting movement of said throttle lever includes said projection.

30. An engine as set forth in claim 29 and further comprising a flywheel cover mounted on said engine block, and wherein said projection is located on said flywheel cover.

31. An engine as set forth in claim 30 and further comprising means including said projection for limiting movement of said throttle link in the direction retarding the spark timing of said engine.

32. An engine as set forth in claim 23 and further comprising means for limiting movement of said throttle link in the direction retarding the spark timing of said engine.

33. An engine as set forth in claim 19 and further comprising a carburetor which is mounted on said engine block and which includes a throttle valve, a throttle cam mounted on said engine block for pivotal movement relative thereto about said roller arm axis, and means for opening and closing said throttle valve in response to movement of said throttle cam.

34. An engine as set forth in claim 33 and further comprising means for connecting said throttle cam to said roller arm actuator for common movement therewith.

35. An engine as set forth in claim 34 wherein said means for connecting said throttle cam to said actuator includes a shaft extending along said roller arm axis and connecting said throttle cam to said actuator.

36. An internal combustion engine comprising an engine block, a spark control member movably mounted on said engine block to control spark timing of said engine in response to movement of said spark control member, an actuating member movably mounted on said engine block, means for adjustably connecting said spark actuating member to said spark control member for common movement, operator actuatable means connected to said actuating member for effecting spark timing control movement thereof, said means for limiting movement of said actuating member relative to said engine block in the direction retarding the spark timing of said engine.

37. An engine as set forth in claim 36 and further comprising means for biasing said spark control member in the direction retarding the spark timing of said engine.

38. An internal combustion engine comprising an engine block, an actuating member which is movably mounted on said engine block and which includes a cam surface, a roller arm mounted on said engine block for pivotal movement relative thereto about a roller arm axis, roller means mounted on said roller arm for common movement therewith and for engaging said cam surface, a roller arm actuator having a first end mounted on said engine block for pivotal movement relative thereto and coaxially with said roller arm, means for adjustably connecting said roller arm actuator to said roller arm for common pivotal movement therewith, means for pivoting said roller arm actuator, and means for controlling the spark timing of said engine in response to movement of said actuating member.

39. An engine as set forth in claim 38 wherein said controlling means includes a spark control member movably mounted on said engine bloc, means for controlling the spark timing of said engine in response to movement of said spark control member, and means for adjustably connecting said actuating member to said spark control member for common movement therewith.

40. An internal combustion engine comprising an engine block, a carburetor which is mounted on said engine block and which includes a throttle valve, a throttle cam mounted on said engine block for pivotal movement relative thereto about a throttle cam axis, means for opening and closing said throttle valve in response to movement of said throttle cam, a roller arm mounted on said engine block for pivotal movement relative thereto about said throttle cam axis, an actuating member mounted on said engine block for pivotal movement relative thereto about said throttle cam axis, means adjustably connecting said actuating member to one of said throttle cam to said roller arm for common movement, means connecting said actuating member to the other of said throttle cam and said roller arm for common movement and means for controlling the spark timing of said engine in response to movement of said roller arm.

41. An internal combustion engine comprising an engine block, a carburetor which is mounted on said engine block and which includes a throttle valve, a throttle cam mounted on said engine block for pivotal movement relative thereto about a throttle cam axis, means for opening and closing said throttle valve in response to movement of said throttle cam, a roller arm mounted on said engine block for pivotal movement relative thereto about said throttle cam axis, means connecting said throttle cam to said roller arm for common movement, said means for connecting said throttle cam to said roller arm including a roller arm actuator mounted on said engine block for pivotal movement relative thereto about said throttle cam axis, means for adjustably connecting said roller arm actuator to said roller arm for common pivotal movement, and means for connecting said throttle cam to said roller arm actuator for common movement, and means for controlling the spark timing of said engine in response to movement of said roller arm.

42. An internal combustion engine comprising an engine block, a throttle lever mounted on said engine block for movement relative thereto between neutral and open positions, a throttle arm mounted on said engine block for movement relative thereto between a first position, a second position, and a third position beyond said second position, means connecting said throttle arm to said throttle lever for moving said throttle lever from said neutral position to said open position in response to movement of said throttle arm from said first position to said second position, means for substantially preventing movement of said throttle lever beyond said open position, and means for substantially preventing movement of said throttle arm beyond said third position.

43. An engine as set forth in claim 42 wherein said connecting means includes a shaft connecting said throttle arm to said throttle lever.

44. An engine as set forth in claim 43 wherein said throttle lever is mounted on said engine block for pivotal movement relative thereto about a throttle lever axis, wherein said throttle arm is mounted on said engine block for pivotal movement relative thereto about said throttle lever axis, and wherein said shaft extends along said throttle lever axis.

45. An engine as set forth in claim 42 and further comprising a carburetor which is mounted on said engine block and which includes a throttle valve, and means for opening and closing said throttle valve in response to movement of said throttle lever.

46. An engine as set forth in claim 45 and further comprising means for controlling the spark timing of said engine in response to movement of said throttle lever.

47. An engine as set forth in claim 42 wherein said engine block includes a limit surface, and wherein said means for substantially preventing movement of said throttle arm includes said limit surface.

48. An engine as set forth in claim 42 and further comprising a throttle link mounted on said engine block for movement relative thereto between neutral and open positions, means for moving said throttle link between said neutral and open positions in response to movement of said throttle lever between said neutral and open positions, and means for substantially preventing movement of said throttle link beyond said neutral position.

49. An engine as set forth in claim 48 wherein said engine block includes a projection, and wherein said means for substantially preventing movement of said throttle lever and said means for substantially preventing movement of said throttle link include said projection.

50. An internal combustion engine comprising an engine block including a projection, a throttle lever mounted on said engine block for movement relative thereto between neutral and opened positions, a throttle link mounted on said engine block for movement relative thereto between neutral and open positions, means for moving said throttle link between said neutral and open positions in response to movement of said throttle lever between said neutral and open positions, and means including said projection for substantially preventing movement of said throttle lever beyond said open position and for substantially preventing movement of said throttle link beyond said neutral position.

51. An engine as set forth in claim 50 and further comprising a carburetor which is mounted on said engine block and which includes a throttle valve, and means for opening and closing said throttle valve in response to movement of said throttle link.

52. An engine as set forth in claim 50 and further comprising a flywheel cover mounted on said engine block, and wherein said projection is located on said flywheel cover.

53. An internal combustion engine operable in idle and wide-open-throttle conditions and comprising first means for controlling the spark timing of said engine, second means for adjusting the spark timing of said engine when said engine is in said wide-open-throttle condition, and third means operable independently of said second means for adjusting the spark timing of said engine when said engine is in said wide-open-throttle condition.

54. An engine set forth in claim 53 and further comprising an engine block, a spark control member movably mounted on said engine block, and means for controlling the spark timing of said engine in response to movement of said spark control member, wherein said first means includes a first actuating member mounted on said engine block, and means for adjustably connecting said first actuating member to said spark control member for common movement therewith, and wherein said second means includes a second actuating member moveably mounted on said engine block, and means for adjustably connecting said second actuating member to said spark control member for common movement therewith.

* * * * *